US010905915B2

(12) United States Patent
Wallace

(10) Patent No.: US 10,905,915 B2
(45) Date of Patent: Feb. 2, 2021

(54) BALANCE PLATFORM WITH CONVEX BASE

(71) Applicant: Maria Susan Wallace, Seattle, WA (US)

(72) Inventor: Maria Susan Wallace, Seattle, WA (US)

( * ) Notice: Subject to any disclaimer, the term of this patent is extended or adjusted under 35 U.S.C. 154(b) by 45 days.

(21) Appl. No.: 16/131,759

(22) Filed: Sep. 14, 2018

(65) Prior Publication Data

US 2019/0091510 A1 Mar. 28, 2019

Related U.S. Application Data

(60) Provisional application No. 62/558,860, filed on Sep. 15, 2017, provisional application No. 62/582,817, filed on Nov. 7, 2017.

(51) Int. Cl.
*A63B 22/18* (2006.01)
*A63B 26/00* (2006.01)

(52) U.S. Cl.
CPC ..... *A63B 22/18* (2013.01); *A63B 26/003* (2013.01); *A63B 2208/0204* (2013.01); *A63B 2208/0233* (2013.01)

(58) Field of Classification Search
CPC ..... A63B 26/003; A63B 2208/0233; A63B 2208/0204; A63B 2208/0096; A63B 2022/0094; A63B 22/14
See application file for complete search history.

(56) References Cited

U.S. PATENT DOCUMENTS

| | | | | |
|---|---|---|---|---|
| 2,764,411 | A | 9/1956 | Washburn, Jr. | |
| 6,422,983 | B1 * | 7/2002 | Weck | A63B 21/0004 482/146 |
| 6,575,885 | B1 * | 6/2003 | Weck | A63B 21/0004 482/146 |
| 6,872,175 | B2 * | 3/2005 | Lin | A63B 21/0004 482/121 |
| 7,357,767 | B2 | 4/2008 | Tsai | |
| 7,566,291 | B2 | 7/2009 | Lickle | |
| 9,320,940 | B2 * | 4/2016 | Rainey | A63B 26/003 |
| 9,457,226 | B2 | 10/2016 | Heath | |
| 9,533,187 | B2 * | 1/2017 | Dalebout | A63B 22/18 |
| 9,566,468 | B2 * | 2/2017 | Crist | A63B 22/18 |

(Continued)

FOREIGN PATENT DOCUMENTS

DE 202010015234 U1 9/2011

OTHER PUBLICATIONS

Revolution Focus Standing Desk Balance Board; https://revbalance.com/standing-desk-balance-boards/.

(Continued)

*Primary Examiner* — Megan Anderson

(57) ABSTRACT

A balance platform configurable to have a second member with a flat side on the ground and a curved side facing upwards, and a first member that rocks on the second member. The elements of this balance platform are interchangeable in position to create different parameters of movement based on the different configurations. This invention may be used as a very easy balance platform for work or when upper body stability is desired. Additionally, there are different curvatures and combinations of curvatures of the surfaces that may be combined to adjust difficulty of balancing.

13 Claims, 11 Drawing Sheets

(56) References Cited

U.S. PATENT DOCUMENTS

| | | | | |
|---|---|---|---|---|
| 10,045,647 | B2 | 8/2018 | Publicover | |
| 2009/0215596 | A1* | 8/2009 | Obermaier | A63B 26/003 482/142 |
| 2012/0277078 | A1* | 11/2012 | Seade | A63B 21/4049 482/142 |
| 2013/0053228 | A1* | 2/2013 | Winegar | A63B 22/16 482/146 |
| 2014/0371041 | A1* | 12/2014 | Terpstra | A63B 22/18 482/146 |
| 2017/0080285 | A1* | 3/2017 | Bentley | A63B 22/20 |

OTHER PUBLICATIONS

Indo Board Original FLO Balance Trainer; https://indoboard.com/original-flo-deck-and-cushion/.
Steppie (Balance Board); https://steppie.dk/en/.

* cited by examiner

BALANCE PLATFORM WITH CONVEX BASE

FIELD OF INVENTION

This invention generally relates to balance boards, and more specifically to balance platforms for work. It is a variation on the type of balance board that wobbles on a spherical support. It is also intended as a work platform to relieve fatigue.

BACKGROUND OF THE INVENTION

Many balance platforms exist, and many are intended for use at a standing desk. Some of the easier balance platforms for work consist of an inflatable disk base with a board on it. This has disadvantages of inelegance and lack of durability of the inflatable.

Some balance platforms for work are very well engineered but lack the simplicity for the user to understand the motion of the surface they are standing on. This leads to problems when the user has to pay conscious attention to the board when they are stepping on and off of it lest it pivot or move unexpectedly away from their foot. The complexity of these boards also means it is hard for them to be customized or made from reclaimed materials.

There exist very difficult sport training balance systems that employ the principle of having one member with a flat bottom and convex top, but because they call for placing a ball on this convex surface, they just wouldn't work.

Besides the main four types of balance platforms (rocker, rocker-roller, wobble, and sphere-and-ring), there are many inventions that call for springs, elastomers, pulleys, or even frames that surround the user. These are hard to manufacture and unintuitive to use.

A further disadvantage of the balance boards commonly sold for use in the office is that they do not sit level on the floor when not in use. For this reason and because most of them have an overhang or lip at just above toe level, they can be awkward for one's co-workers to walk around. Additionally, the lower surface of the rocking region can damage the floor.

Most known balance boards pivot, even if they are not of the type with side to side travel. This is desirable for some users at some times, but they lack the option for the user to eliminate pivot when they want to.

Even in the field of balance boards that are deliberately easy to use, they are not easy enough. If the user has to remain consciously aware that they are on a balance board it may detract from their focus on other tasks. On the other hand, cushioning mats are not stimulating to the balancing faculties, mentally or physically, and do not address the tendency of active people to become restless when at a stationary task.

Therefore, there is a need for a balance platform which overcomes the disadvantages listed above.

BRIEF SUMMARY OF THE INVENTION

This balance platform has at least two parts, a first part (first or upper member) and a second part (second or lower member). The first part (first or upper member) is planar, rigid, and boardlike, and the second part (second or lower member) is of a strength sufficient to retain a convex upper surface when supporting a user. Each part has two major horizontal surfaces, a first or upper surface and a second or lower surface. In every embodiment, this invention functions as a balance platform when the second part (second or lower member) is placed on the floor or other supporting structure with the second or lower surface facing downward and the first or upper surface facing upward, and the first part (first or upper member) is placed thereon with the second or lower surface facing downward and the first or upper surface facing upward. The second or lower surface of the second part (second or lower member) is substantially flat, the first or upper surface of the second part (second or lower member) is curved outward convexly, the second or lower surface of the first part (first or upper member) is either substantially flat or concave, and the first or upper surface of the first part (first or upper member) is substantially flat. In this primary configuration a user balances on the first surface of the first part. Additionally, in some embodiments, the parts may be stacked vertically in a different order, and with either part flipped so either horizontal face thereof is placed upward. The parts may be stacked vertically in any order, and with either part flipped so either horizontal face thereof is placed upward. The first part may have a flange, and the second part may have curved rails that nest either inside or outside said flange, or a curved surface that rests inside said flange. The degree and profile of the curvature of the at least one curved surface of the second part may vary, and may be uniaxial or biaxial. In addition, there may be a curved surface on the first part, configured to interface mechanically with the at least one curved surface of the second part in a desired manner. For example, the balance platform used at a standing desk could have a curve defined by a longitudinal arc as long as the length of the platform and 2 cm high and a lateral spline curve as wide as the width of the platform and of equal height. Furthermore, multiple first parts and second parts may be configured and used to provide different degrees of balancing difficulty for the user or users. The parts of each pair may be of any compatible perimeter shapes, such as two circles, two squares, and so forth. Embodiments of this balance platform may be configured to study human physiology or the nervous system, including the balancing faculties, or to provide data to an interface, such as for games or physical assessments. Various embodiments of this balance platform may be used as standing platforms for work, exercise devices, or as seats or parts of seats, or for other purposes.

BRIEF DESCRIPTIONS OF THE SEVERAL VIEWS OF THE DRAWINGS

The following figures represent the balance platform in limited views.

DETAILED DESCRIPTION OF THE INVENTION

Figure 1:
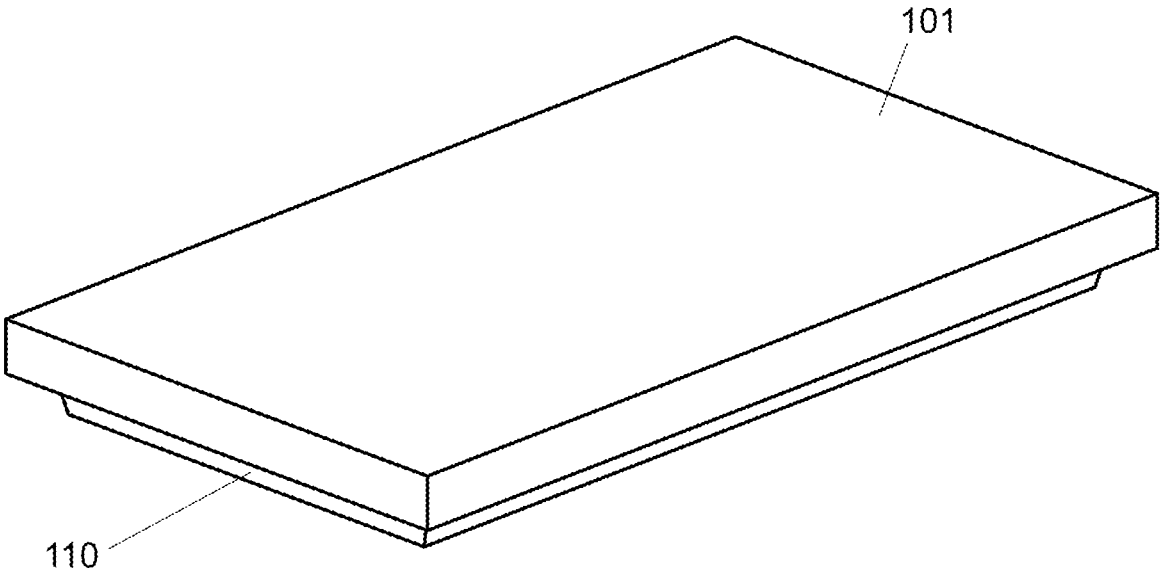
FIG. 1 is a top perspective view of an embodiment of a balance platform.
Figure 2:
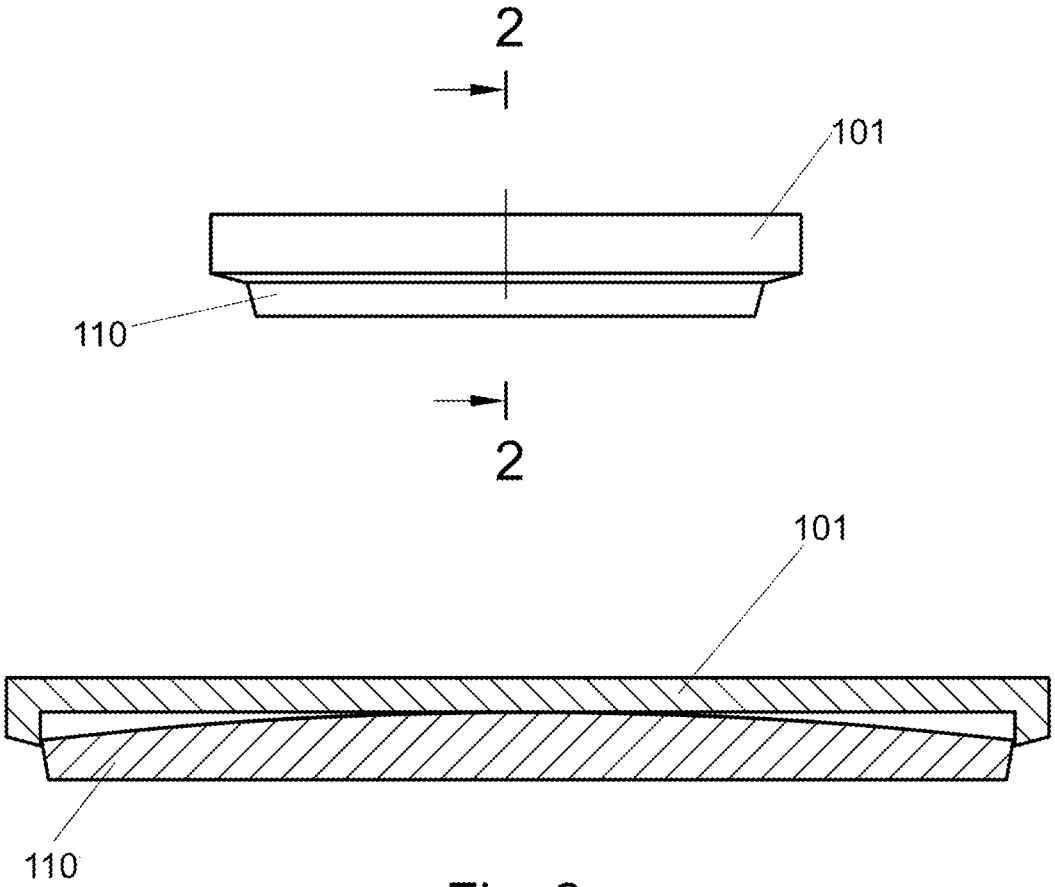
FIG. 2 is a right side view with corresponding sectional view of the balance platform of FIG. 1 along line 2-2.
Figure 3:
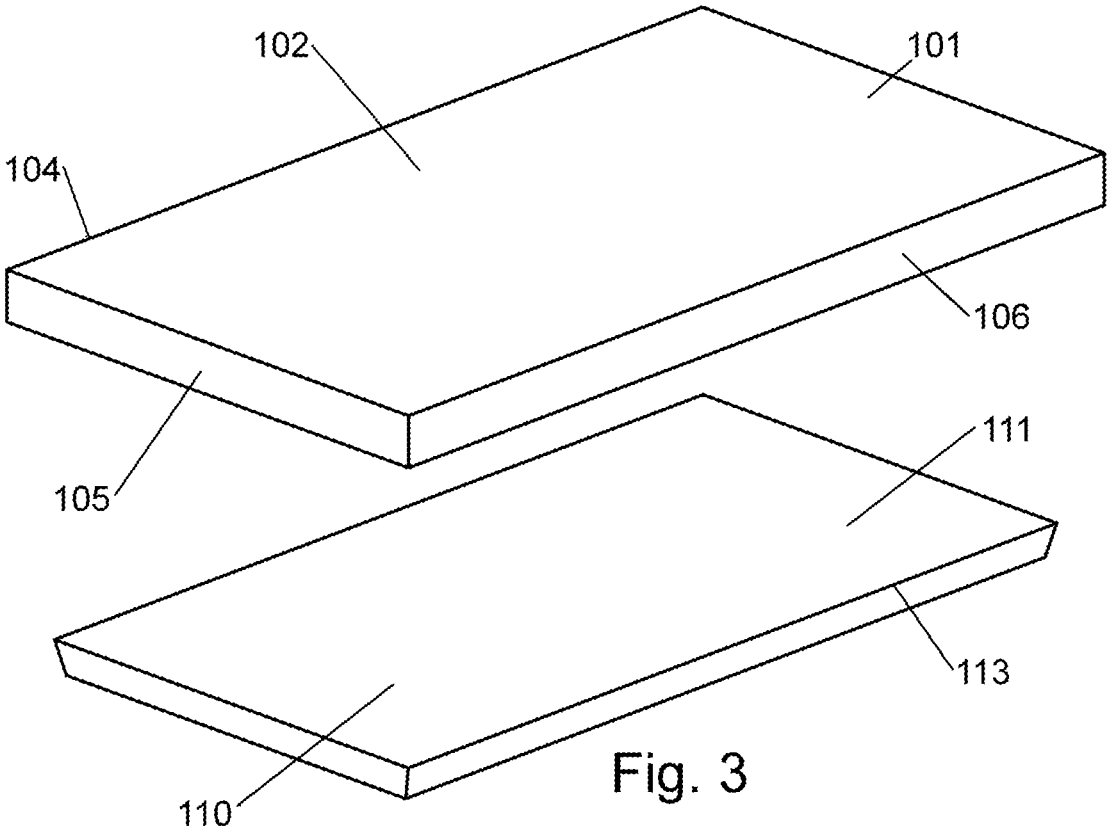
FIG. 3 is a top perspective view of the balance platform of FIG. 1.
Figure 4:
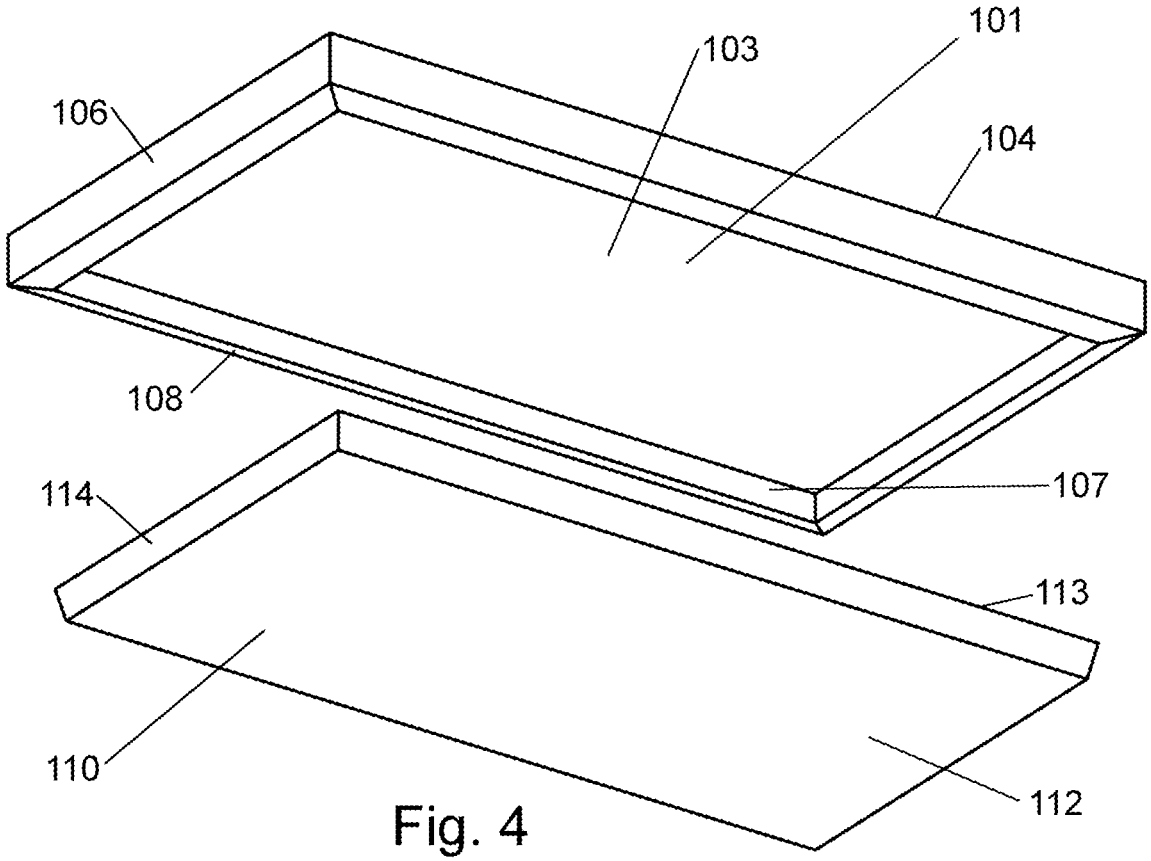
FIG. 4 is a bottom perspective view of the balance platform of FIG. 1.
Figure 5:
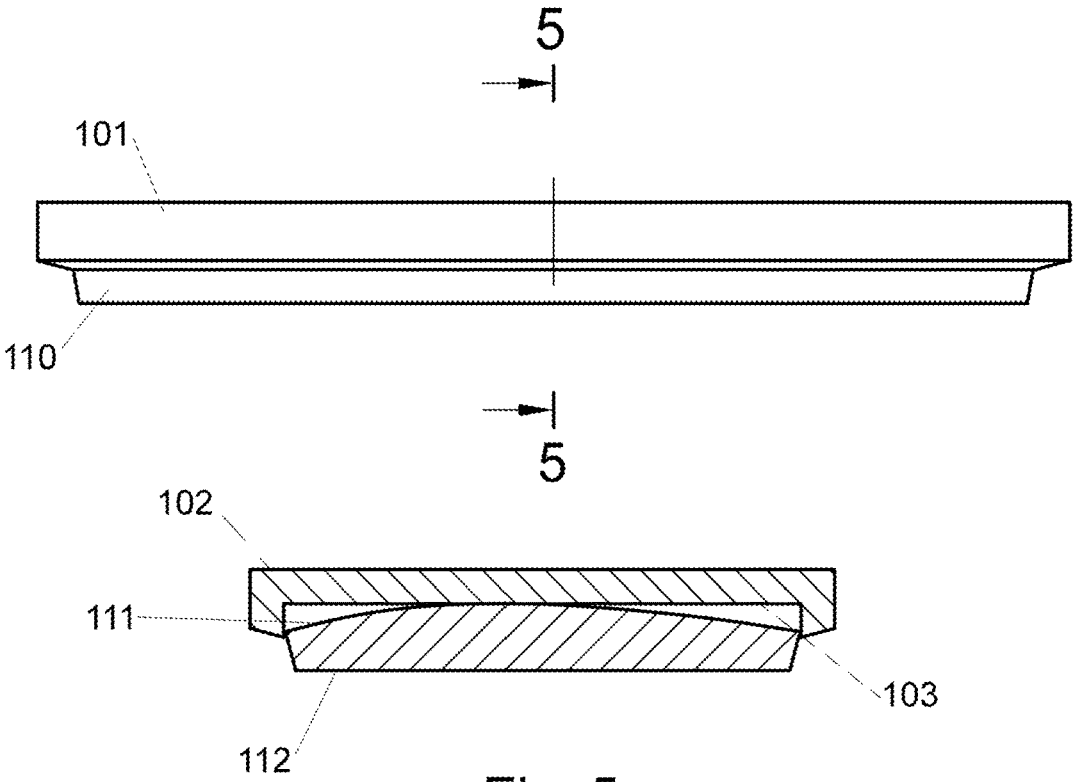
FIG. 5 is a front view with corresponding sectional view of the balance platform of FIG. 1 along line 5-5.
Figure 6:
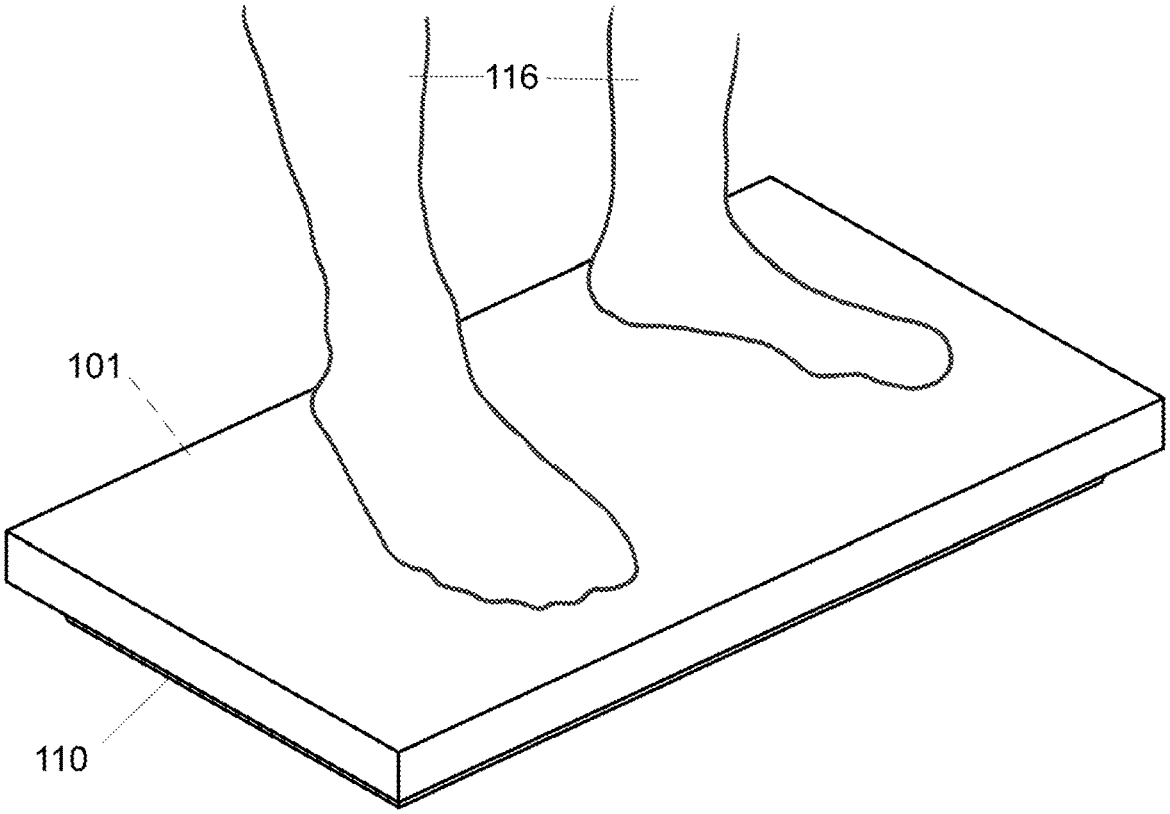
FIG. 6 is a top perspective view of a user standing on the board of FIG. 1 in a neutral stance.
Figure 7:
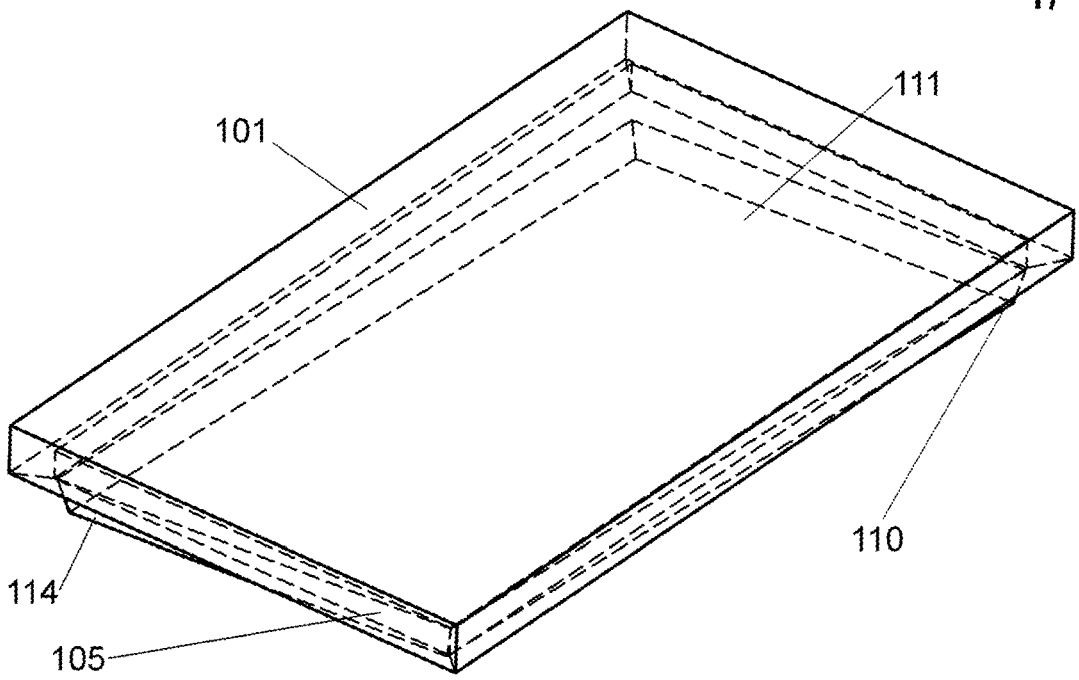
FIG. 7 is a top perspective view of the balance platform of FIG. 1 with dashed hidden lines showing its rocked position.
Figure 8:
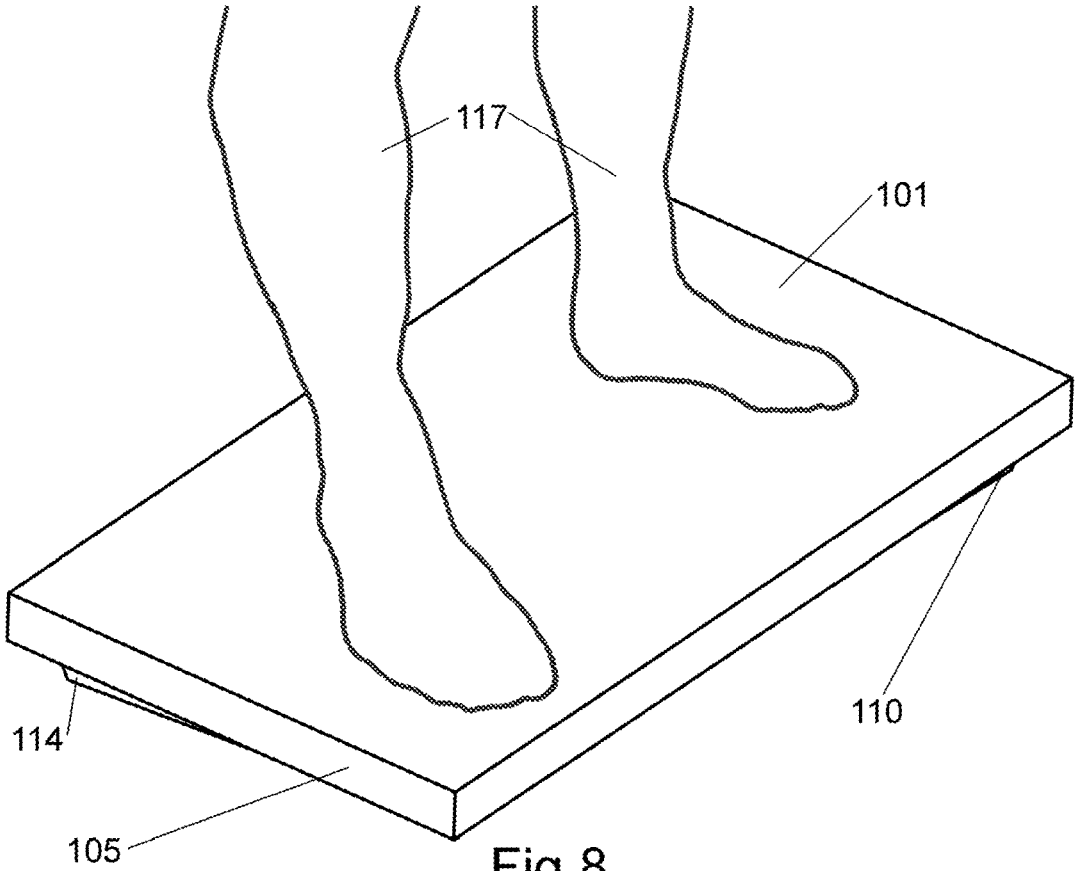
FIG. 8 is a top perspective view of a user standing on the board of FIG. 1 in an active stance.
Figure 9:
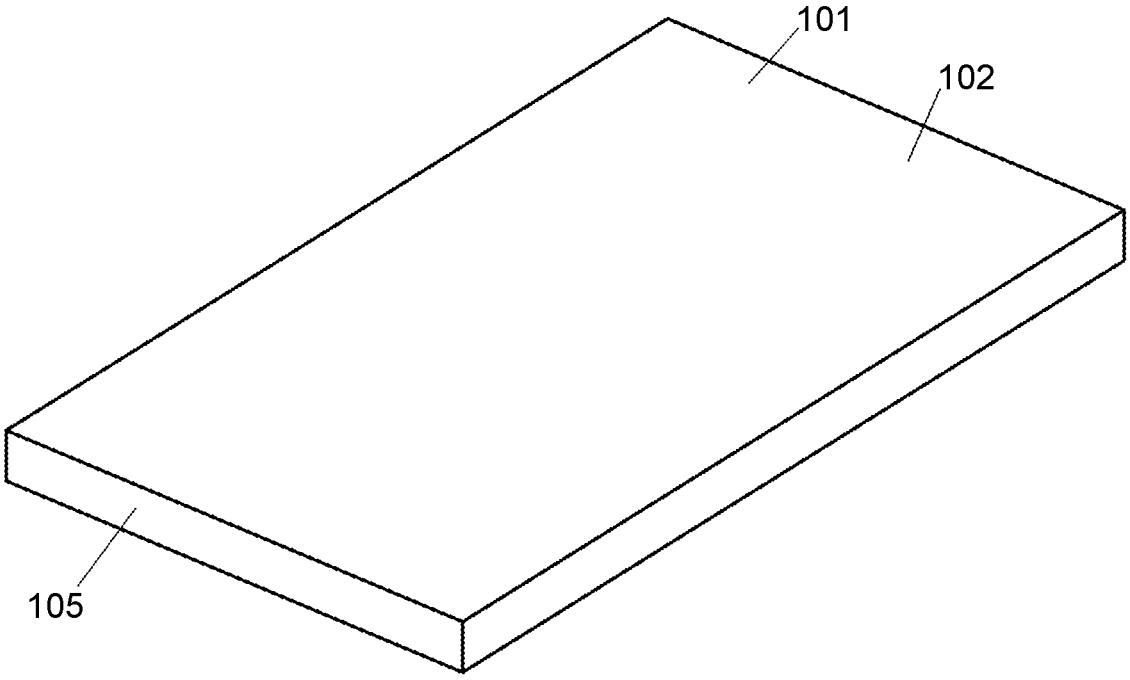
FIG. 9 is a top perspective view of another configuration of the balance platform of FIG. 1.
Figure 10:
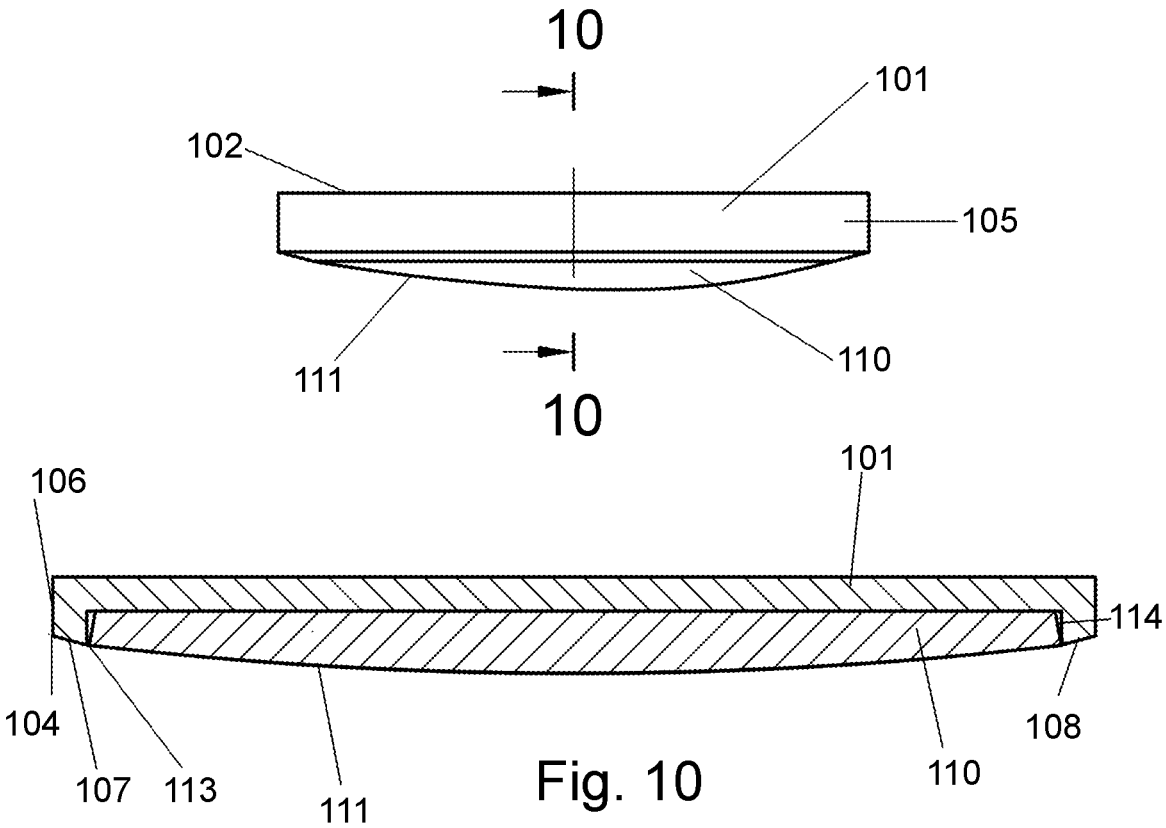
FIG. 10 is a left side view with corresponding sectional view of the configuration of FIG. 9 along line 10-10.
Figure 11:
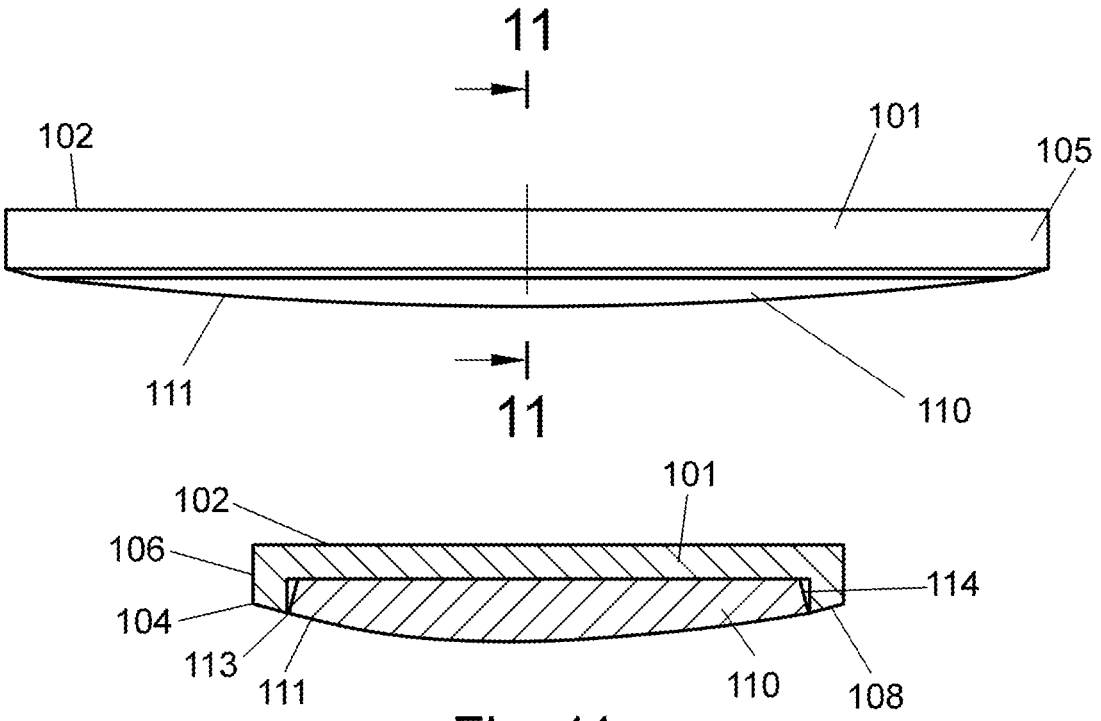
FIG. 11 is a front view with corresponding sectional view of the configuration of FIG. 9 along line 11-11.
Figure 12:
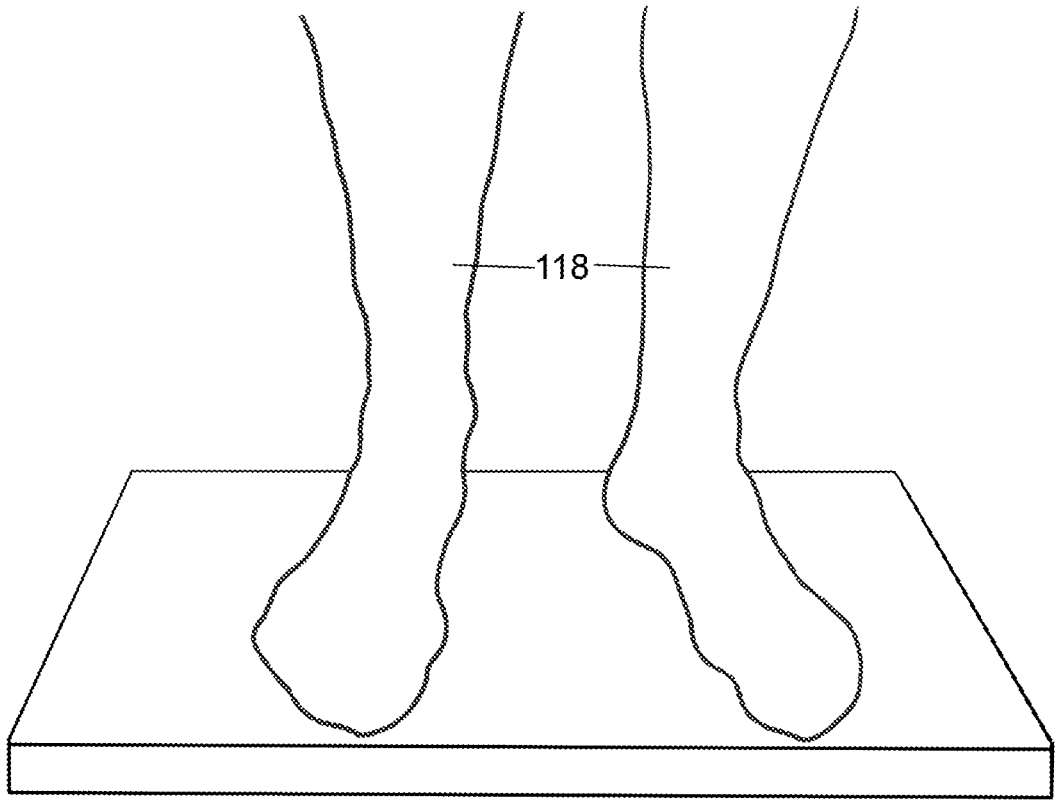
FIG. 12 is a front perspective view of a user standing on the board of FIG. 1 in an active stance.

Specific descriptions of various embodiments of the balance platform relative to the drawings are explained, however these do not account for all possible embodiments.

FIGS. 1-12 show an embodiment of the platform having a rectangular perimeter (104) in the first member (101) and a rectangular perimeter (113) in the second member (110). The first member (101) has a first surface (102), a second surface (103), and a flange (105). The second member (110) has a first surface (111), a second surface (112), and a sidewall (114). The flange (105) of the first member (101) has an outer surface (106), an inner surface (107), and a lower surface (108). FIGS. 1-8 show a configuration of the embodiment of FIG. 1 wherein the first surface (111) of the second member (110) is placed facing upward and FIGS. 9-12 show a configuration of the embodiment of FIG. 1 wherein the first surface (111) of the second member (110) is placed facing downward. In this and all other figures the terms "righthand" and "lefthand" refer to the sides of the board where the right and left hands, respectively, of the user are located when said user is facing forward. In addition FIGS. 1-12 show sectional views as follows: 2-2 is a sectional view of a longitudinal midsection of the configuration of FIG. 1; 5-5 is a sectional view of a lateral midsection of the configuration of FIG. 1; 10-10 is a sectional view a longitudinal midsection of the configuration of FIG. 9; and 11-11 is a sectional view of a lateral midsection of the configuration of FIG. 9. This lateral sectional view shows that the outermost point of the curve of the first surface (111) from the main body of the second member (110) would be centered more under the ankle of the user than the mid-foot. In this embodiment, the top member (101) is a substantially planar, rigid, boardlike object having two substantially opposite and horizontal surfaces. This member could be made of wood, a substantially strong polymer, a reinforced elastomer, sheet metal, or other suitable material or combination of materials. It can be made by traditional woodworking, casting, or other manufacturing or handcrafting means. The lower member (110) is a solid, hollow, or shelled object having a substantially horizontal and convexly curved first surface (111) and a substantially horizontal, rigid, flat lower surface (112) substantially opposite to the first surface. This member could be made of wood, a substantially strong polymer, an elastomer, sheet metal, or other suitable material or combination of materials. It can be made by CNC router woodworking, casting, or other manufacturing means.

A biaxial curve such as describes the surface (111) can be drafted in a CAD program, and said surface (111) can be milled using a CNC router or made using another subtractive CNC manufacturing process, or printed in a 3D printer or made using another additive CNC manufacturing process. Alternatively, a positive of the first surface (111) of the second member (110) or the entire second member (110) made using a CNC process can be used to make molds for a casting or other mold-based process. Alternatively, a negative can made directly into a mold using a CAD-CNC process. Alternatively, both members or any member or surface of this or other embodiments can be made using additive or subtractive CNC manufacturing, or molds created using additive or subtractive CNC manufacturing.

In this and other embodiments the surfaces referred to as "substantially flat" may have cushioning, texture such as expanded mesh, or may have other voids which do not affect the flatness of the contact of the surface on the floor, the users feet, or the other members in the configuration.

In addition to the base material or materials used to make the top member (101) and the bottom member (111), coatings or layers of material may be used such as a cushion coating or layer of material on the first surface of the first member (102) or the second surface of the second member (112), a non-slip coating or layer of material on the second surface surface of the first member (103) or the first surface of the second member (111), or a slippery coating or layer of material on the flange inner surface (107) or second member sidewall (112,114).

This embodiment of the platform is sized to accommodate a user's feet and stance, and allow them to shift their stance during its use. In other embodiments it could be sized for a seated user, or of a size similar to a surfboard.

FIGS. 1-12 also show a potential manner of engagement of the perimeter (104) of the top member (101) with the perimeter (113) of the lower member (110) using a flange (105) and sidewall (114). The flange (105) is disposed outside of the sidewall (114) and limits its lateral and longitudinal motion. At the same time, the sidewall (114) is angled off of vertical, so that the second surface (112) of the second member (110) is smaller than the perimeter (113) of the second member. This angle should be equal to or greater than the maximum tilt of the first member (101). Additionally the lower surface (108) of the flange (105) is angled off of horizontal so that the outer surface (106) is smaller than the inner surface (107). This degree should be equal or greater than the maximum tilt of the first member (101).

Figure 13:
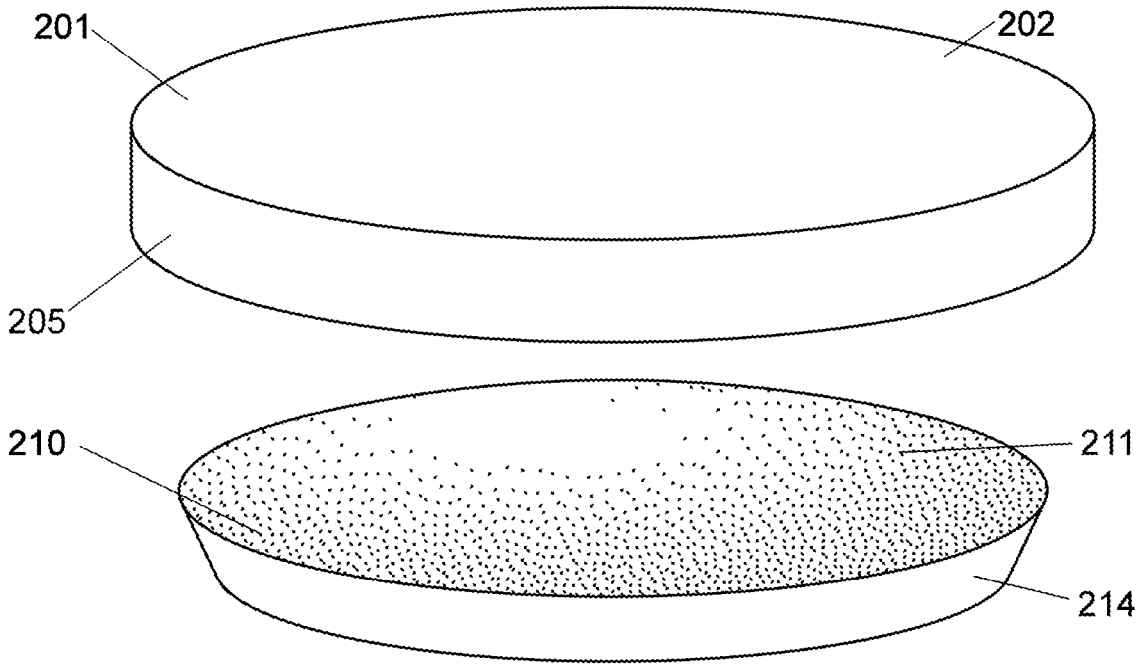
FIG. 13 is a top perspective view of an embodiment of a balance platform.
Figure 14:
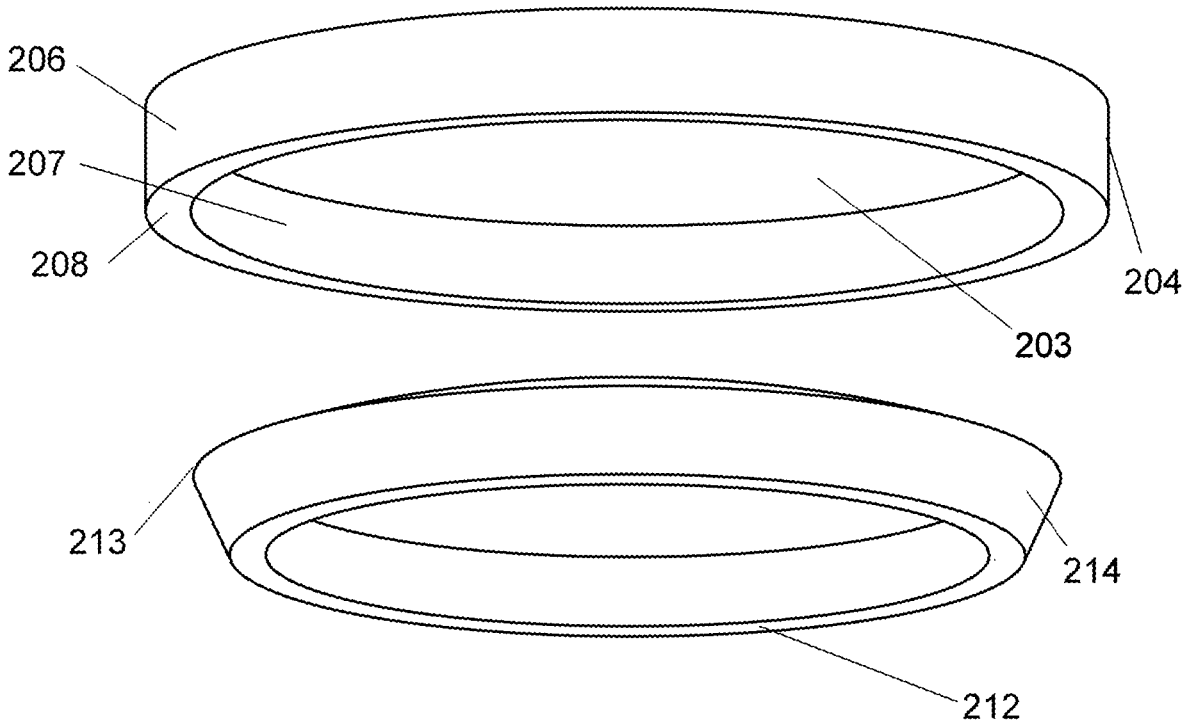
FIG. 14 is a bottom perspective view of the balance platform of FIG. 13.

FIG. 13-14 show an embodiment of the platform having an elliptical perimeter (204) in the first member (201) and an elliptical perimeter (213) in the second member (210). The first member (201) has a first surface (202), a second surface (203), and a flange (205). The second member (210) has a first surface (211), a second surface (212), and a sidewall (214). The flange (205) of the first member (201) has an outer surface (206), an inner surface (207), and a lower surface (208).

Figure 15:
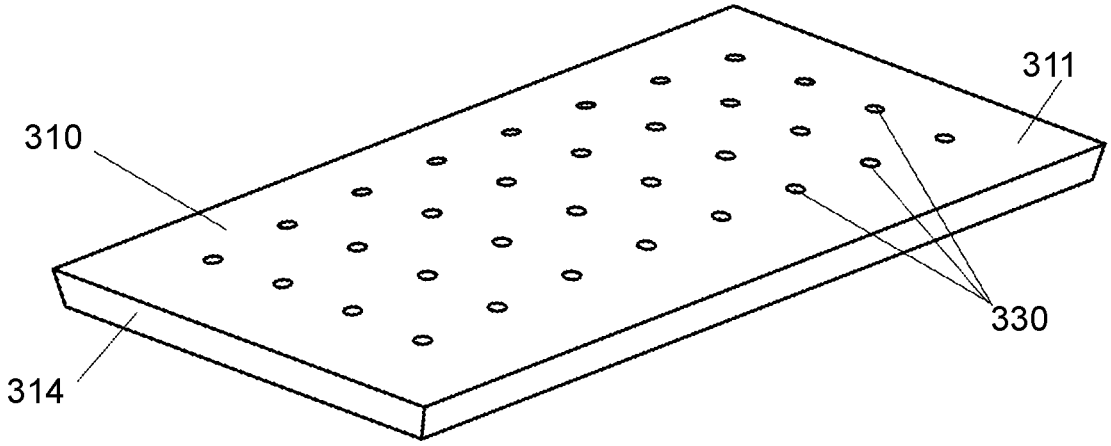
FIG. 15 is a top perspective view of an embodiment of a balance platform.
Figure 16:
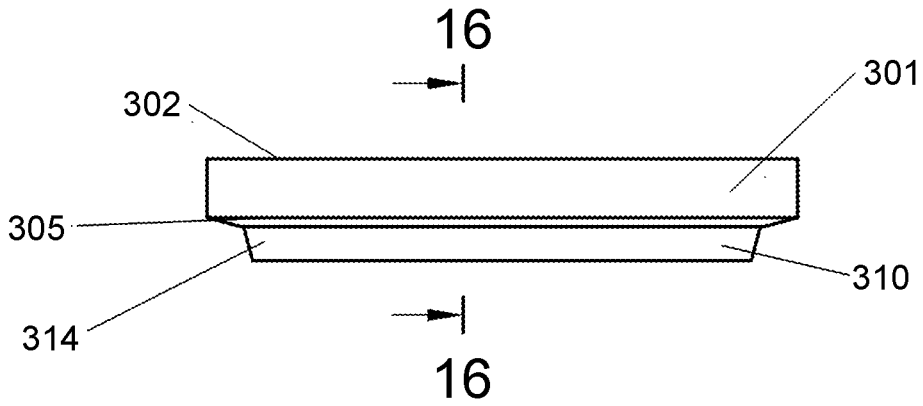
FIG. 16 is a side view with corresponding sectional view of the balance platform of FIG. 15 along line 16-16.
Figure 16:
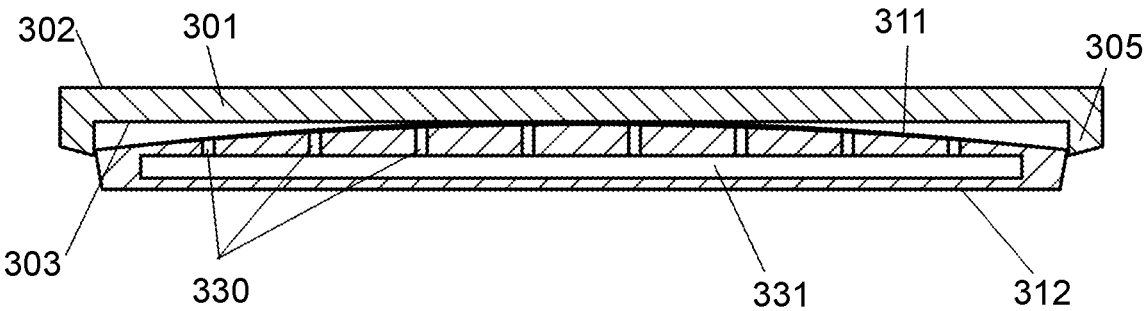

FIGS. 15-16 show an embodiment of the platform having an array of sensors (330) and a means for processing data (331). This embodiment has a first member (301) and a second member (310). The first member (301) has a first surface (302), a second surface (303), and a flange (305). The second member (310) has a first surface (311), a second surface (312), and a sidewall (314). This embodiment may be configured with the first surface (311) of the second member (310) facing upward or with the first surface (311) of the second member (310) facing downward, however if configured with the first surface (311) of the second member (310) facing upward, the second member (310) is relatively stationary and can even be attached to the floor. In this configuration it is easier to attach any physical data transmission means to the board.

Figure 17:
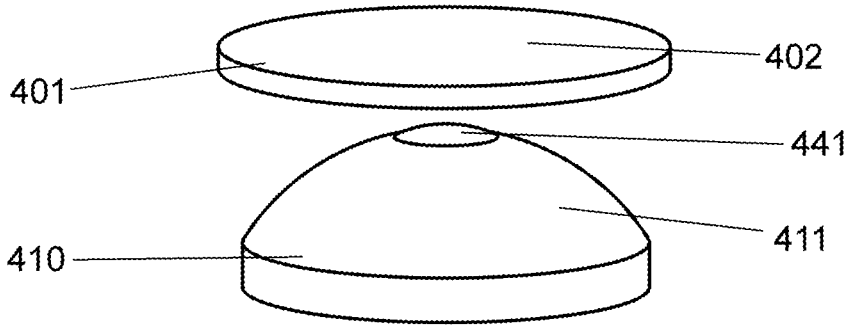
FIG. 17 is a top perspective view of an embodiment of a balance platform.
Figure 18:
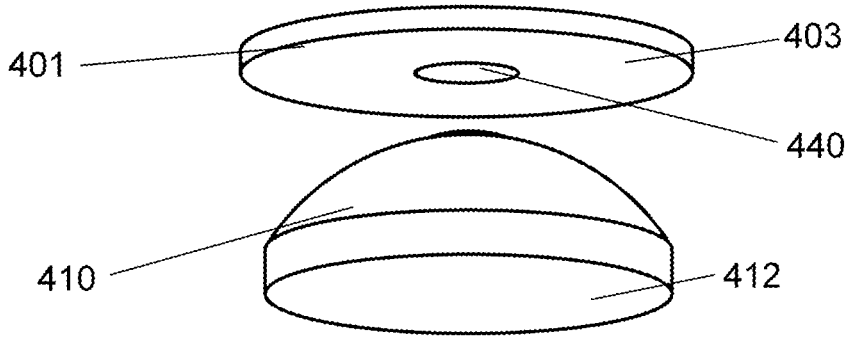
FIG. 18 is a bottom perspective view of the balance platform of FIG. 16.
Figure 19:
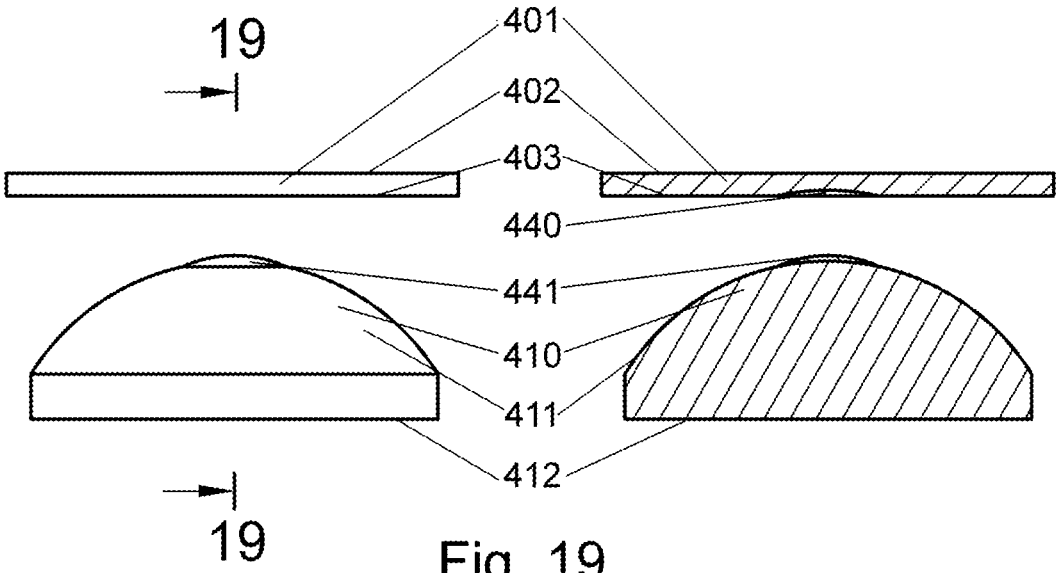
FIG. 19 is a front view with corresponding sectional view of the embodiment of FIG. 17 along line 19-19.

FIGS. 17-19 show another embodiment of the platform having an additional nesting contour set on the second surface (403) of the first member (401) and the first surface (411) of the second member (410). In this embodiment, the difference in curvature between the additional contour (440) on the first member (401) and the additional contour (441) on the second member (410) is equal to the difference in curvature between the second surface (403) of the first member (401) and the first surface (411) of the second member (410). This additional contour serves to align the first and second members horizontally.

Figure 20:
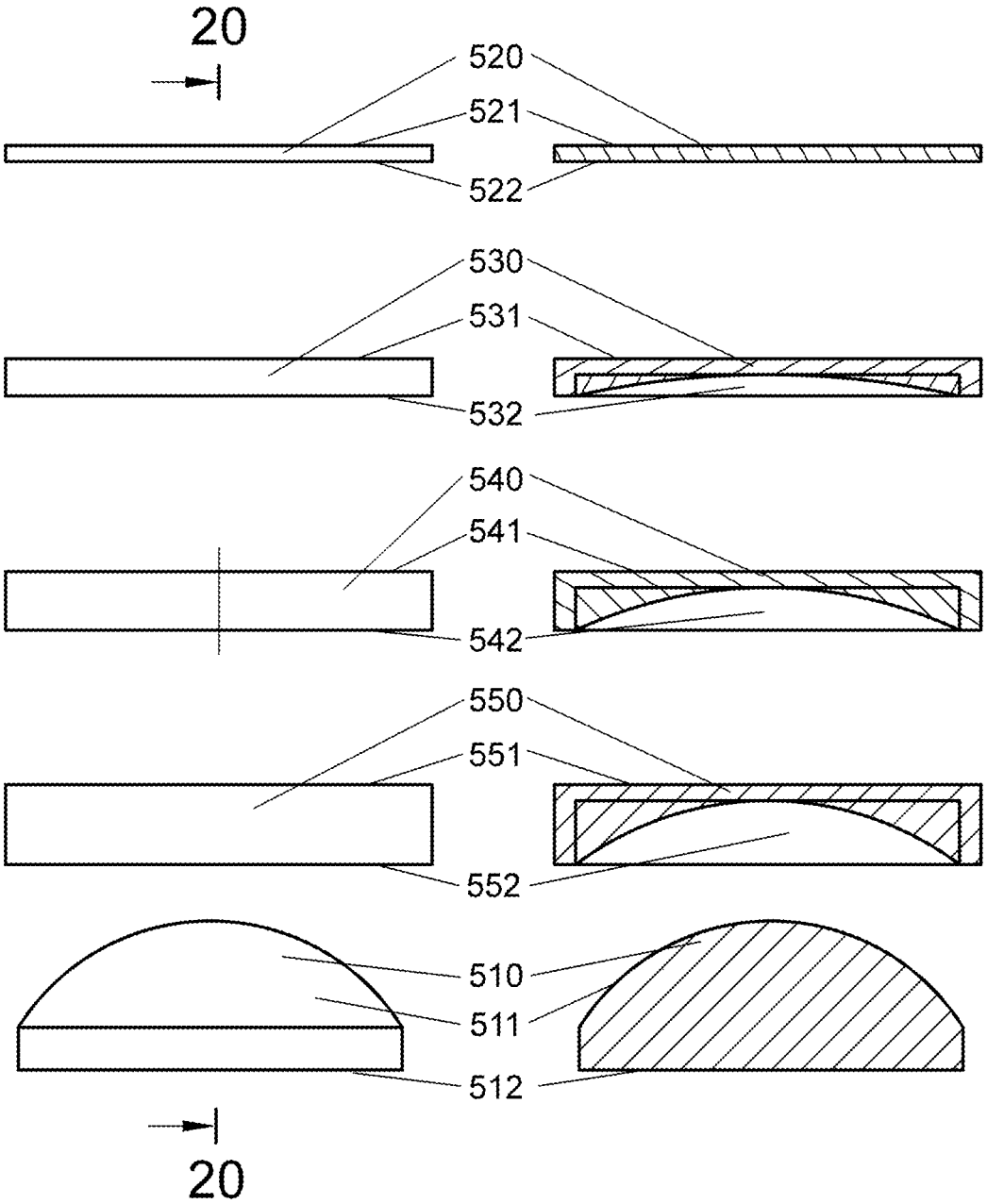
FIG. 20 is a front view with corresponding sectional view of an embodiment of the invention.
Figure 21:
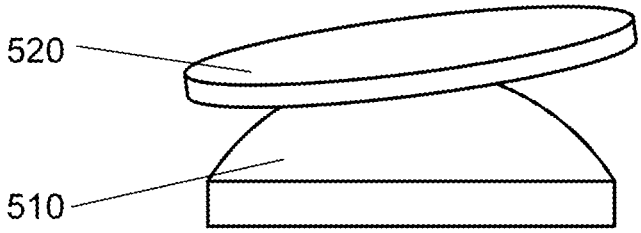
FIG. 21 is a front view of a configuration of the embodiment of FIG. 20.
Figure 22:
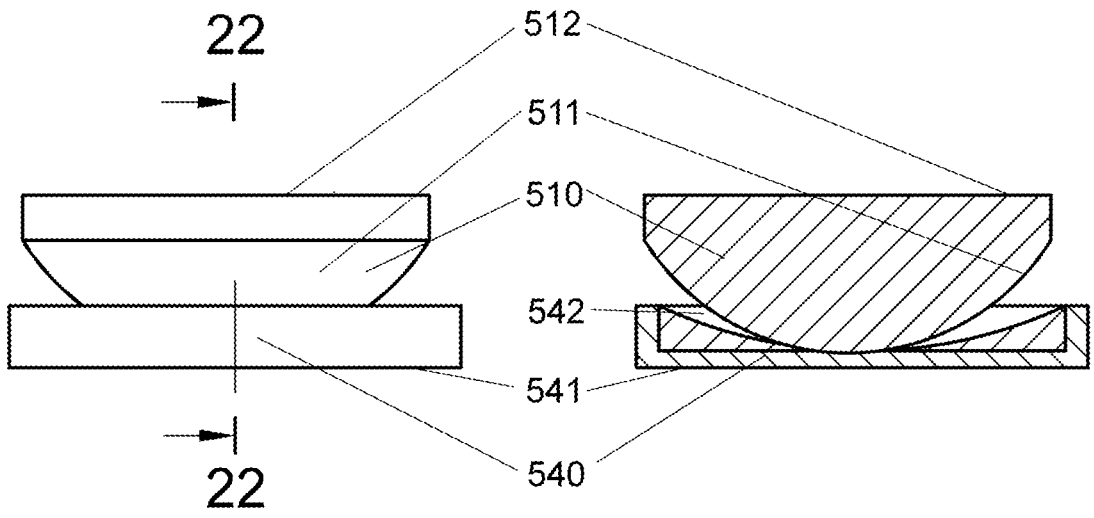
FIG. 22 is a front view with corresponding sectional view of a configuration of the embodiment of FIG. 20.

FIGS. 20-22 show an embodiment of the invention having a domed member (510) and a plurality of dished members (520, 530, 540, and 550). Domed member (510) has a convex first surface (511) and a substantially flat second surface (512). The first dished member (520) has a substantially flat first surface (521) and a substantially flat second surface (512). The second dished member (530) has a substantially flat first surface (531) and a slightly concave second surface (532). The third dished member (540) has a substantially flat first surface (541) and a moderately concave second surface (542). The fourth dished member (550) has a substantially flat first surface (551) and a substantially concave second surface (552). The curvature of the second surface (552) of the fourth dished member is less than the curvature of the first surface (511) of the domed member (510). The user can change the difficulty of this embodiment of the balance platform by choosing which of the dished members that they combine with the domed member (510). This embodiment can also be configured with any of the dished members placed on the ground with the dished surface facing upward and the the domed member (510) placed atop with the first surface (511) thereof facing downward as in FIG. 22.

Figure 23:
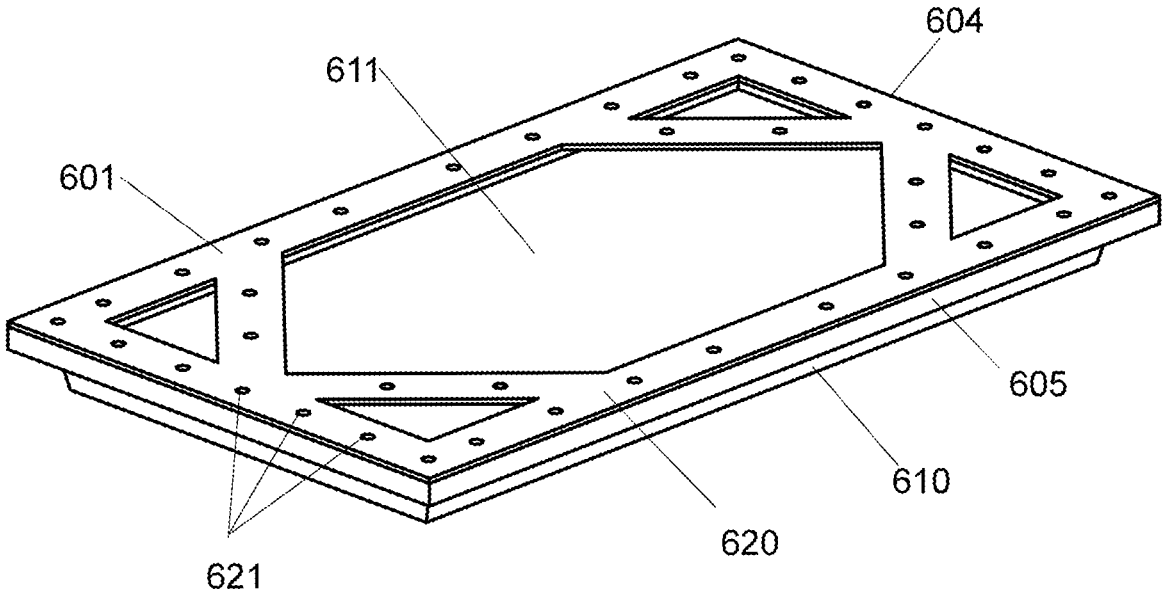
FIG. 23 is a top perspective view of an embodiment of a balance platform.

FIG. 23 shows an embodiment of the invention having an attachment plate (602) to which a customer may affix their own materials to form the body of the first member (601). This embodiment has a rectangular perimeter (604) in the first member (601) and a rectangular perimeter in the second member (610). The first member (601) has a first surface (602), a second surface (603), and a flange (605). The second member (610) has a first surface (611), a second surface, and a sidewall. The attachment plate (602) has a means of attachment to the custom materials that form the body of the first member (601) in combination with the flange (605). The means of attachment may be through-holes for screws, as pictured, or adhesive, or a combination thereof, or other mechanical or chemical means of attachment.

The embodiments of the balance platform described herein are presented as descriptive examples. The scope of the invention should not be limited by the drawings or the description contained in the specification, as many modifications could be made to these forms without departing from the spirit and scope of the invention. Therefore, the scope of the invention is to be interpreted broadly based on the following claims.

The invention claimed is:

1. A balance platform comprising a first member and a second member, said first member comprising a first surface and a second surface and said second member comprising a first surface and a second surface, said first member being rigid, said first surface of said first member is flat, said first surface of said second member being curved outward convexly, and said second surface of said first member being flatter than said first surface of said second member, and said second surface of said second member being flat; wherein the first and second member are configured to be placed in the following configurations:

wherein said second member is placed on the ground with said second surface thereof facing downward and said first surface thereof facing upward, and said first member placed thereon, said first surface of said first member facing upward and said second surface of said first member facing downward and contacting said first surface of said second member, wherein said second member is placed on the ground with said first surface thereof facing downward and said second surface thereof facing upward, and said first member placed thereon, said first surface of said first member facing upward and said second surface of said first member facing downward and contacting said second surface of said second member, wherein said first member is placed on the ground with said first surface thereof facing downward and said second surface thereof facing upward, and said second member placed thereon, said first surface of said second member facing downward and said second surface of said second member facing upward and said first surface of said second member contacting said second surface of said first member, and wherein said first member is placed on the ground with said second surface thereof facing downward and said first surface thereof facing upward, and said second member placed thereon, said first surface of said second member facing downward and said second surface of said second member facing upward and said first surface of said second member contacting said first surface of said first member.

2. The balance platform of claim 1 wherein said first and second members are configured to be horizontally reversible.

3. The balance platform of claim 1 wherein said first surface of said first member is placed on the ground and said second surface of said first member is placed facing upward, and said second member is placed thereon, said first surface of said second member facing downward and said second surface of said second member facing upward and said second surface of said first member contacting said first surface of said second member.

4. The balance platform of claim 1 wherein said first member is placed on the ground with said second surface thereof facing downward and said first surface thereof facing upward, and said second member is placed thereon, said first surface of said second member facing downward and said second surface of said second member facing upward and said first surface of said first member contacting said first surface of said second member.

5. The platform of claim 1, wherein a perimeter of the first member communicates with a perimeter of the second member.

6. The balance platform of claim 1, said balance platform also comprising at least one sensor.

7. The balance platform of claim 1 wherein said balance platform is configured to accept the placement of sensors therein.

8. The balance platform of claim 1 wherein said first surface of said second member comprises an additional contour and said second surface of said first member also comprises an additional contour, said additional contour of said first surface of said second member being adapted to communicate with said additional contour of said second surface of said first member.

9. A balance platform comprising a first member and a second member, said first member comprising a first surface, a second surface, and a flange, and said second member comprising a first surface, a second surface, and a sidewall, said first member being rigid, said first surface of said first member being horizontal and flat and said first surface of said second member being horizontal and curved outward convexly, said second surface of said first member being horizontal and flatter than said first surface of said second member, and said second surface of said second member being horizontal and flat, and said flange of said first member extending vertically from said perimeter of said second surface of said first member, said first surface and said second surface of said first member being connected by at least an edge, and said sidewall of said second member being vertical and connecting the first and second surfaces of the second member; wherein the first and second member are configured to be placed in the following configurations:

wherein said second member is placed on the ground with said second surface thereof facing downward and said first surface thereof facing upward, and said first member placed thereon, said first surface of said first member facing upward and said second surface of said first member facing downward and contacting said first surface of said second member, wherein said second member is placed on the ground with said first surface thereof facing downward and said second surface thereof facing upward, and said first member placed thereon, said first surface of said first member facing upward and said second surface of said first member facing downward and contacting said second surface of said second member, wherein said first member is placed on the ground with said first surface thereof facing downward and said second surface thereof facing upward, and said second member placed thereon, said first surface of said second member facing downward and said second surface of said second member facing upward and said first surface of said second member contacting said second surface of said first member, and wherein said first member is placed on the ground with said second surface thereof facing downward and said first surface thereof facing upward, and said second member placed thereon, said first surface of said second member facing downward and said second surface of said second member facing upward and said first surface of said second member contacting said first surface of said first member.

10. The balance platform of claim 9 wherein said flange comprises an outer surface, an inner surface and a lower surface, said lower surface being of an angle to allow full movement of the first member relative to the floor.

11. The balance platform of claim 9 wherein said sidewall of said second member is of an angle to allow full movement of the first member relative to the floor.

12. The balance platform of claim 9 wherein said lower surface of said first member comprises an attachment plate, said attachment plate being configured to join said flange with a material or materials whose upper surface or surfaces form the upper surface of said first member.

13. A method of operating a balance platform comprising; providing a platform having a first member and a second member, said first member being rigid, said first member comprising a first surface and a second surface and said second member comprising a first surface and a second surface, said first surface of said first member being flat, said first surface of said second member being curved outward convexly, and said second surface of said first member being flatter than said first surface of said second member, and said second surface of said second member being flat; wherein the first and second member are configured to be placed in the following configurations:

wherein said second member is on the ground with said second surface thereof facing downward and said first surface thereof facing upward, and said first member placed thereon, said first surface of said first member facing upward and said second surface of said first member facing downward and contacting said first surface of said second member, wherein said second member is on the ground with said first surface thereof facing downward and said second surface thereof facing upward, and said first member placed thereon, said first surface of said first member facing upward and said second surface of said first member facing downward and contacting said second surface of said second member, wherein said first member is on the ground with said first surface thereof facing downward and said second surface thereof facing upward, and said second member placed thereon, said first surface of said second member facing downward and said second surface of said second member facing upward and said first surface of said second member contacting said second surface of said first member, and wherein said first member is on the ground with said second surface thereof facing downward and said first surface thereof facing upward, and said second member placed thereon, said first surface of said second member facing downward and said second surface of said second member facing upward and said first surface of said second member contacting said first surface of said first member.

* * * * *